US005525292A

United States Patent [19]

Nakao et al.

[11] Patent Number: 5,525,292

[45] Date of Patent: Jun. 11, 1996

[54] PROCESS FOR PRODUCING ALUMINUM SINTERING

[75] Inventors: Yasuhiro Nakao; Kunitoshi Sugaya; Shigehisa Seya; Takeshi Sakuma, all of Saitama-ken, Japan

[73] Assignee: Honda Giken Kogyo Kabushiki Kaisha, Tokyo, Japan

[21] Appl. No.: 502,324

[22] Filed: Jul. 13, 1995

[30] Foreign Application Priority Data

Jul. 20, 1994 [JP] Japan ..... 6-168478
Jul. 20, 1994 [JP] Japan ..... 6-168479

[51] Int. Cl.[6] ..... R22F 3/00

[52] U.S. Cl. ..... 419/45; 419/2; 419/19; 419/57; 419/58; 419/37

[58] Field of Search ..... 419/2, 19, 45, 419/57, 58, 37

[56] References Cited

U.S. PATENT DOCUMENTS

| | | | |
|---|---|---|---|
| 4,483,819 | 11/1984 | Albrecht et al. | 419/2 |
| 4,687,632 | 8/1987 | Hurd et al. | 419/45 |
| 4,752,333 | 6/1988 | Caisso et al. | 75/232 |
| 5,015,440 | 5/1991 | Bowden | 419/31 |
| 5,045,278 | 9/1991 | Das et al. | 419/16 |
| 5,304,343 | 4/1994 | Miura et al. | 419/39 |

FOREIGN PATENT DOCUMENTS

| | | |
|---|---|---|
| 0577436 | 1/1994 | European Pat. Off. . |
| 633164 | 2/1994 | Japan . |
| 657363 | 3/1994 | Japan . |

*Primary Examiner*—Donald P. Walsh
*Assistant Examiner*—Daniel Jenkins
*Attorney, Agent, or Firm*—Weiner, Carrier & Burt; Joseph P. Carrier; Irving M. Weiner

[57] ABSTRACT

A process is disclosed for producing an aluminum or an aluminum alloy sintering, comprising successive steps of maintaining a rare gas atmosphere inside a sintering furnace while heating a compact of aluminum particles or aluminum alloy particles, together with a magnesium source; reducing the pressure inside the sintering furnace while heating further for thereby sublimating magnesium nitrogen to generate $Mg_3N_2$ and bringing the generated $Mg_3N_2$ into contact with $Al_2O_3$ in the surface of the compact for the reduction of $Al_2O_3$, thereby effecting heating and sintering at a temperature lower than the melting point of aluminum. The process increases the bonding strength of the aluminum alloy particles while fully taking the advantage of a sintering process. Thus, it enables aluminum sinterings or aluminum-alloy sinterings improved in yield point, strength, and elongation.

20 Claims, 6 Drawing Sheets

Fig. 1
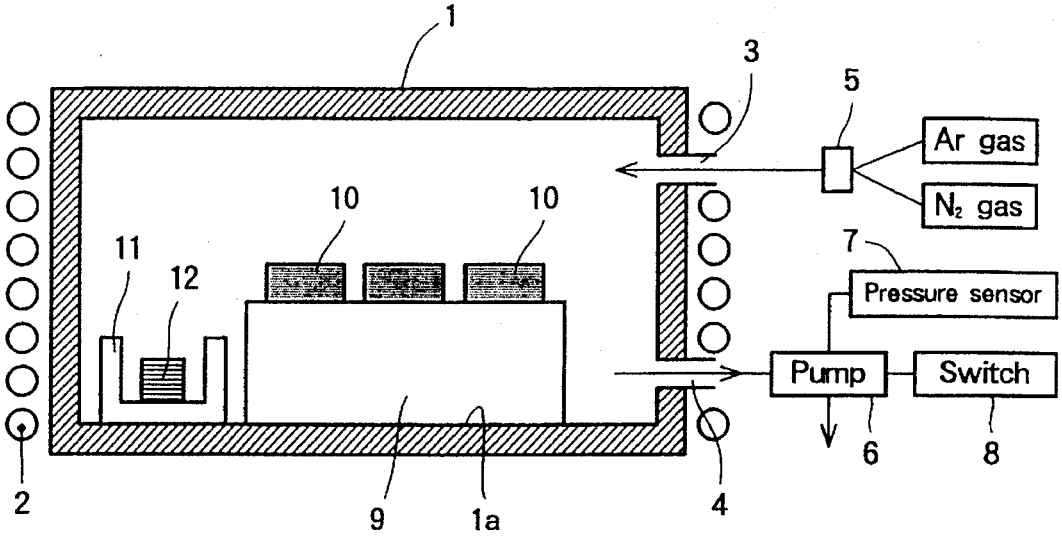
Fig. 2 (A)
Fig. 2 (B)
Fig. 2 (C)
Fig. 2 (D)
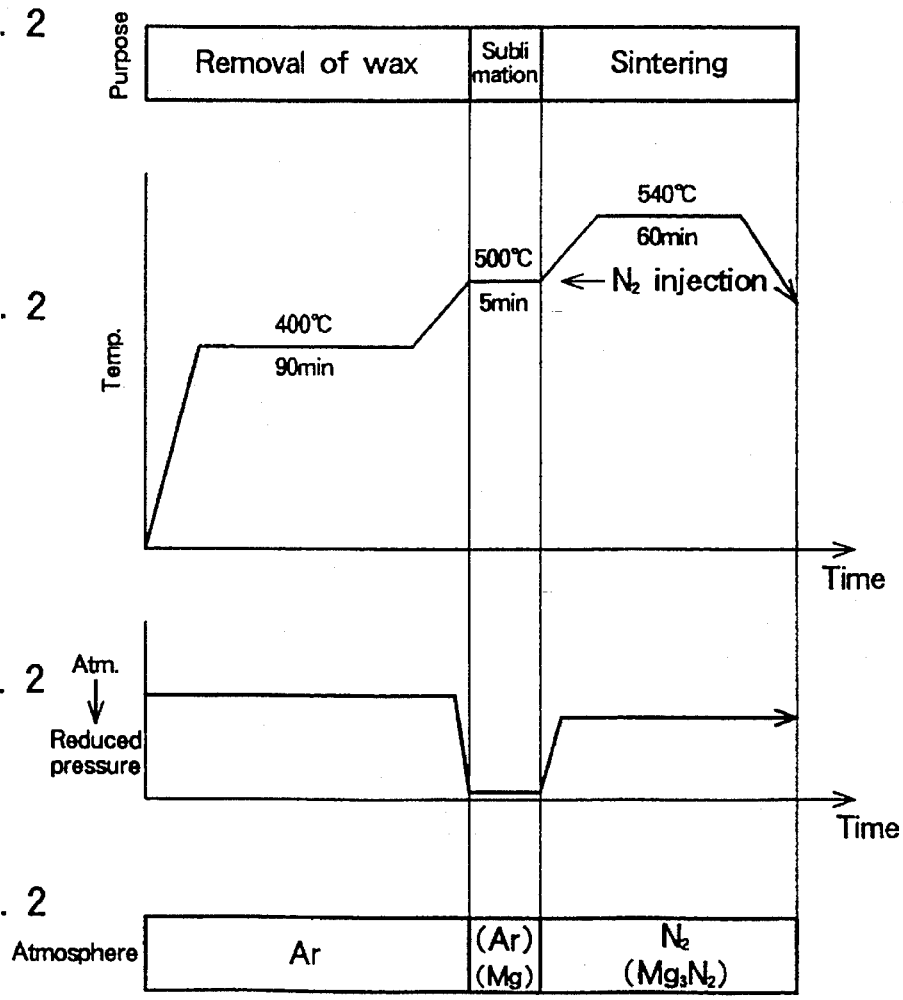

PROCESS FOR PRODUCING ALUMINUM SINTERING

BACKGROUND OF THE INVENTION

1. Field of the Invention

The present invention relates to a process for producing an aluminum sintering and an aluminum-alloy sintering.

2. Description of the Related Art

Powder metallurgy has been well known heretofore as a technology which comprises compression molding a powder of a metal or an alloy and then sintering the resulting molding at a temperature not higher than the melting point of the metal or the alloy.

Powder metallurgy is advantageous in that it directly enables a product to be shaped from a powder without applying additional processing such as cutting or grinding, and that it allows the production of any article having a complicated shape.

Although powder metallurgy has the merits above, it is not always applicable to every type of metallic powder.

Particularly, in case of an aluminum sintering, a stubborn oxide film ($Al_2O_3$) generated on the surface of the particles constituting the powder of aluminum or an aluminum alloy. The oxide film ($Al_2O_3$) which covers the surface of the particles during the sintering process prevents the atoms of aluminum or an aluminum alloy from strongly bonding with each other.

As a related art process, Japanese patent Laid Open No. Hei6-33164 and Hei6-57363 each disclose a technology for sintering an aluminum alloy powder.

Laid Open No. Hei6-33164 discloses a technology which comprises preparing an aluminum alloy powder containing magnesium, heating the powder in an atmosphere containing nitrogen to form a nitride on the surface portion of the powder, and hot processing the powder having a nitride coating thereon into a product having the desired shape.

According to the technology, an aluminum alloy member having an improved toughness, strength, and wear resistance can be obtained by producing a grain-dispersed aluminum alloy through the process of producing the material using a powder of the aluminum alloy.

According to the technology disclosed in Laid Open No. Hei6-57363, a melt of an aluminum alloy containing magnesium at a predetermined percentage by weight is solidified at a predetermined rate of solidification to obtain a quench-solidified powder of an aluminum alloy, and the resulting powder is subjected to cold compression molding. If necessary, the powder is subjected to annealing in a predetermined temperature range before the cold compression molding. The molding is then sintered under ordinary pressure in an atmosphere containing water vapor and nitrogen each at predetermined partial pressures, and into which a predetermined quantity of a reducing gas is added as a gaseous component which accelerates the formation of a nitrogen compound. In this manner, a compound of nitrogen is formed on the surface of the powder, and a nitrided aluminum-alloy sintering containing from 0.4 to 4.0% by weight of magnesium and from 0.2 to 4.0% by weight of nitrogen is obtained therefrom.

According to the technology above, a sintered aluminum alloy having excellent mechanical properties, physical properties, and wear resistance can be obtained at a high density and precision. Moreover, the alloy can be produced highly economically by normal pressure sintering without applying any plastic processing.

The related art technology described above both comprises forming a nitride (AlN) on the surface of the powder particles of aluminum to increase the sintering density. Although the bonding strength is found to somewhat increase as compared with the case of sintering an aluminum powder having a film of aluminum oxide ($Al_2O_3$) on the surface of the particles, it is also found that there is yet more problems to be overcome.

The prevent invention aims to overcome the aforementioned problems.

An object of the present invention is to provide, in producing sinterings of an aluminum powder or an aluminum alloy powder, a process for producing an aluminum sintering in which the bonding strength among the particles of aluminum or an aluminum alloy is increased, yet taking the advantage of a sintering process.

SUMMARY OF THE INVENTION

The present invention comprises subjecting a powder compact of aluminum or an aluminum alloy to a heating process under reduced pressure in a rare gas atmosphere together with a magnesium source which has been separately provided while introducing a nitriding gas, or subjecting a mixture of magnesium and aluminum or an aluminum alloy containing magnesium to a heating process under reduced pressure in a rare gas atmosphere, and then introducing a nitriding gas, thereby diffusing sublimated magnesium or magnesium alloy into the surface and the inside of an aluminum or an aluminum-alloy sintering.

More specifically, according to a first aspect of the present invention, there is provided a process for producing an aluminum sintering, comprising: setting a compact of aluminum powder or an aluminum alloy powder inside a furnace together with magnesium or a magnesium alloy; heating the furnace while maintaining a rare gas atmosphere inside the furnace; sublimating said magnesium or magnesium alloy by heating the furnace while reducing the pressure and maintaining the rare gas atmosphere inside the furnace; and introducing gaseous nitrogen inside the furnace while heating the inside of the furnace at a temperature not higher than the melting point of the powder compact, thereby reacting the sublimated magnesium or magnesium alloy with nitrogen to generate magnesium nitride ($Mg_3N_2$) and exposing metallic aluminum by bringing the resulting magnesium nitride into contact with aluminum oxide ($Al_2O_3$) on the surface of the aluminum powder or the aluminum alloy powder for the reduction of aluminum oxide and while sintering the compact.

According to a second aspect of the present invention, there is provided a process for producing an aluminum sintering, comprising: setting, inside a furnace, a compact of a powder of aluminum with magnesium mixed therein or of an aluminum alloy powder containing magnesium; heating the furnace while maintaining a rare gas atmosphere inside the furnace; sublimating said magnesium from the powder compact of aluminum containing magnesium mixed therein or the powder compact of aluminum alloy containing magnesium, by heating the furnace while reducing the pressure and maintaining the rare gas atmosphere inside the furnace; and introducing gaseous nitrogen inside the furnace while heating the inside of the furnace at a temperature not higher than the melting point of the powder compact, thereby reacting the sublimated magnesium with nitrogen to generate magnesium nitride ($Mg_3N_2$) and exposing metallic aluminum to effect sintering by bringing the resulting magnesium nitride into contact with aluminum oxide ($Al_2O_3$) on the surface of the aluminum powder or the aluminum alloy powder for the reduction of aluminum oxide.

Preferably, the sublimation of magnesium is effected in a rare gas atmosphere under a reduced pressure, and the amount of magnesium in the initial compact is 0.3% by weight or more.

The present invention enables an aluminum or an aluminumalloy sintering in which the aluminum alloy grains are bonded with each another at high strength while otherwise taking advantage of a favorable aspects of a sintering process for a powder compact. Moreover, a sintering of aluminum or aluminum alloy having excellent yield point (proof stress), tensile strength, and elongation can be obtained.

Other objects, advantages and salient features of the invention will become apparent from the following detailed description which, when taken in conjunction with the appended drawings, describes preferred embodiments of the invention.

BRIEF DESCRIPTION OF THE DRAWINGS

FIG. 1 is a schematically drawn cross sectional vertical side view of a sintering furnace for use in performing a process for producing an aluminum sintering according to a first aspect of the present invention;

FIGS. 2(A) to 2(D) are jointly a diagram showing the process patterns inside the sintering furnace, wherein FIG. 2(A) shows the objects of the processes, FIG. 2(B) shows the process temperatures by taking the temperature in the ordinate and the time duration in the abscissa, FIG. 2(C) shows the pressure inside the furnace by taking the pressure in the ordinate and the time duration in the abscissa, and FIG. 2(D) shows the gas atmosphere inside the furnace by taking the time duration in the abscissa;

DETAILED DESCRIPTION OF THE INVENTION

Figure 3:
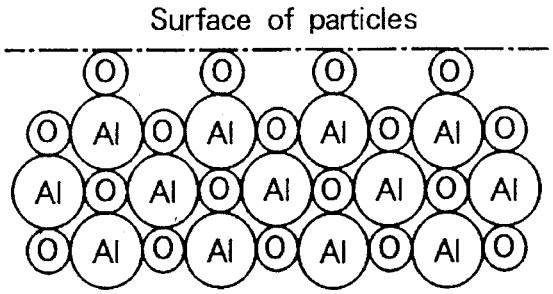
FIG. 3 is a schematically shown arrangement of atoms inside a particle of aluminum powder before magnesium undergoes sublimation according to a first aspect of the present invention.

Preferred embodiments according to the present invention are described in further detail below with reference to the attached drawings.

The present invention is characterized in that it comprises subjecting a powder compact of aluminum or an aluminum alloy to a heating process under reduced pressure in a rare gas atmosphere together with a separately provided magnesium while introducing a nitriding gas, or subjecting a mixture of magnesium and aluminum or an aluminum alloy containing magnesium to a heating process under reduced pressure in a rare gas atmosphere while introducing a nitriding gas, thereby diffusing sublimated magnesium or magnesium alloy into the surface and the inside of an aluminum or an aluminum-alloy sintering. The diffused magnesium initially reacts with the nitriding gas to form magnesium nitride $Mg_3N_2$, which in turn reacts with aluminum oxide $Al_2O_3$ in the particles of the powder compact to expose aluminum at the particles' surfaces during the sintering process.

An embodiment according to a first aspect of the present invention is described below.

FIG. 1 is a schematically drawn cross sectional side view of a sintering furnace for use in performing a process for producing an aluminum sintering according to an embodiment of the present invention.

Referring to FIG. 1, a sintering furnace for use in a process according to the present invention comprises a heater 2 surrounding a furnace body 1, and the furnace body 1 comprises a gas supply inlet 3 and a gas exhaust outlet 4 on one side thereof. The gas supply inlet 3 is equipped with a switching valve 5 so that argon gas or nitrogen gas can be selected according to the demand. The gas exhaust outlet 4 is connected to a pump 6, so that the inside of the furnace body 1 may be evacuated by operating the pump 6. The pump 6 is turned ON or OFF by the pressure sensor 7 that detects the pressure inside the furnace body 1 or by means of a manual switch 8.

A mount 9 on which a powder compact 10 of aluminum or an aluminum alloy is set is provided on the floor 1*a* of the furnace body 1. A crucible 11 is placed on the floor 1*a* of the furnace body 1 neighboring the powder compact. The crucible 11 contains magnesium or a magnesium alloy 12. More specifically, for example, an Al-Mg alloy containing 30% by weight or more of magnesium is preferred. The powder compact 10 to be processed is free of magnesium. Otherwise, in case it contains magnesium, the concentration thereof must be 0.3% by weight or less.

If a powder compact 10 containing magnesium at a high concentration should be used, the crucible 11 with Mg alloy placed therein need not be provided inside the furnace body 1.

The process for sintering the powder compact is described below.

FIGS. 2(A) to 2(D) each show the procedures of the sintering process. FIG. 2(A) indicates what is accomplished in each of the process steps with time duration taken in the abscissa. In FIG. 2(B), the abscissa and the ordinate represents the process duration and temperature respectively; the graph shows the change in process temperature with changing duration of time. In FIG. 2 (C), the abscissa and the ordinate represents the process duration and pressure, respectively; the graph shows the change in pressure inside the furnace 1 with changing duration of time. FIG. 2(D) shows the change in gas atmosphere inside the furnace 1 with time duration taken in the abscissa. The graphs given in FIGS. 2(A) to 2(D) are shown with the same time duration taken in the abscissa to make the process conditions readily understood.

Referring to FIG. 2(D), a rare gas such as gaseous argon is introduced inside the furnace 1 to set a rare gas atmosphere inside the furnace 1. As shown in FIG. 2(C), the pressure inside the furnace is set at the atmospheric pressure. The powder compact is then heated at, for example, as shown in FIG. 2(B), at 400° C. for a duration of 90 minutes. During this heat treatment, the wax incorporated into the powder compact 10 as a lubricant and a binder is removed by melting and evaporation. This process is shown in FIG. 2(A) marked with (1).

FIG. 3 is a schematically shown particle structure inside the powder compact 10. In this stage, a layer of $Al_2O_3$ containing aluminum (Al) atoms and (O) atoms tightly bonded with each other exits on the surface of the aluminum alloy powder particles. The atmosphere inside the furnace can be changed into a rare gas at the stage when magnesium is gasified, which is to be described hereinafter.

The inside of the furnace body 1 is evacuated thereafter as shown in FIG. 2(C). For instance, the pressure inside the furnace is reduced to 10 Torr or lower, and more preferably, to a pressure of about 0.1 Torr. Then, as shown in FIG. 2(B), the rare gas atmosphere is maintained at 500° C. for a duration of 5 minutes.

The magnesium alloy inside the crucible 11 is then sublimated (gasified). This step is indicated with (2) in FIG. 2(A). The atmosphere inside the furnace can be seen by the corresponding regions shown in FIG. 2(D). The gaseous magnesium thus obtained by sublimation uniformly diffuses inside the furnace, as well as in the surface and the inside of the powder compact 10, without reacting with argon.

Usable rare gases include, in addition to the aforementioned argon, helium (He), neon (Ne), krypton (Kr), xenon (Xe), and radon (Rn).

Figure 4:
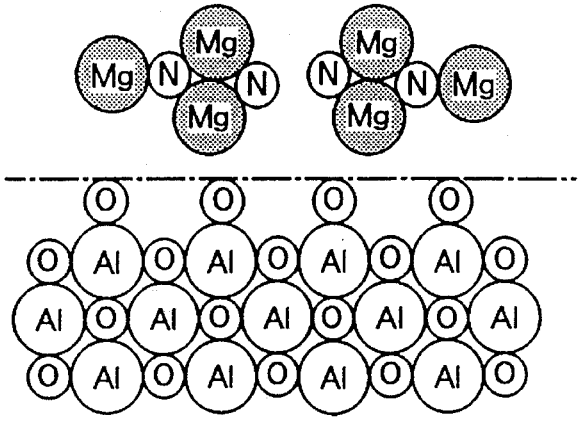
FIG. 4 is a schematically shown bonding state of sublimated magnesium with nitrogen.

Then, gaseous nitrogen ($N_2$) is introduced at once inside the furnace body 1. At the same time, the temperature inside the furnace is elevated to a value not higher than the melting point of A1, for instance, to 540° C., as shown in FIG. 5(B). By introducing gaseous nitrogen ($N_2$), the sublimated gaseous magnesium and nitrogen undergo reaction as to generate magnesium nitride ($Mg_3N_2$) as shown in FIG. 4.

The thus generated magnesium nitride ($Mg_3N_2$) contacts with aluminum oxide ($Al_2O_3$) on the surface of aluminum powder particles, and effects a reducing action.

Figure 5:
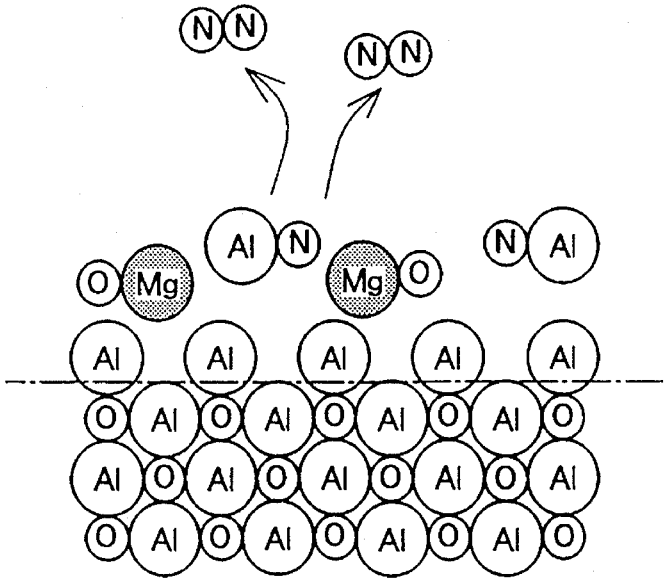
FIG. 5 is a schematically shown exposed state of aluminum while magnesium is bonded with oxygen.

Referring to FIG. 5, $Al_2O_3$ reacts with Mg and $Mg_3N_2$; to generate MgO, and oxygen atoms desorbs from $Al_2O_3$ to expose metallic aluminum atoms on the surface of the particles. The reaction which occurs inside the furnace can be represented by the following formulae:

$$3Mg_{(gas)}+N_2=Mg_3N_2 \quad (1)$$

$$2Mg_3N_2+2Al_2O_3=2AlN+6MgO+2Al+N_2 \quad (2)$$

$$Mg_3N_2+2Al_2O_3+3Mg=2AlN+6MgO+2Al \quad (3)$$

Gibbs free energy of formation (ΔG) is negative for all of the reactions expressed by the formulae above. Hence, the reactions expressed above proceed from the left hand side to the right hand side of the equations. It can be seen therefrom that oxygen atoms desorb from $A1_2O_3$ in the presence of $Mg_3N_2$. The step involving the reaction is indicated with (3) in FIG. 2(A).

In Table 1 are compared the characteristics of the sintered products produced by the process according to the present invention with those produced by other processes.

The process conditions are given below.

Sintering (present invention)

An Al-10Si-4Cu alloy system is used as the starting material. More specifically, the starting mixed powder contains 33.3% by weight of an aluminum alloy containing 30% by weight of silicon (referred to simply hereinafter as "A1-30 wt. %Si alloy")powder, 20% by weight of A1-20 wt. %Cu, from 0.5 to 2% by weight of wax, and balance pure A1.

The powder of the material above passed through a 100-mesh sieve is mixed for 30 minutes in a twin-cylinder mixer, and is compressed into a powder compact having a relative density of from 60 to 85% by applying a pressure in a range of from 4 to 6 ton/cm$^2$. $Mg_3N_2$ can be diffused uniformly inside the molding by controlling the density of the molding in the thus specified range of from 60 to 85%.

The powder compact is heated at 400° C. for a duration of 90minutes in gaseous argon for the first stage heating, and at 540° C. for a duration of 60 minutes in gaseous nitrogen ($N_2$ ) for the final, sintering stage heating. Magnesium of 100% purity is set inside the crucible.

Forging

Forging is effected at a draught of 40% by maintaining the mold temperature at 400° C. and the billet temperature at 450° C.

Heat Treatment

Heat treatment is effected by setting the solution heat treatment temperature at 490° C. and performing aging at 190° C. for a duration of 3 hours.

TABLE 1

| | Use of Mg Source | Use of $N_2$ gas | Yield Point (MPa) | Tensile Strength (MPa) | Elongation (%) |
|---|---|---|---|---|---|
| Present Invention | Yes | Yes | 269 | 315 | 3.8 |
| Comp. Ex. 1 (No Mg source) | No | Yes | 185 | 220 | 1 ≦ |
| Comp. Ex. 2 (No $N_2$ gas) | Yes | No | 180 | 210 | 1 ≦ |

Table 1 indicates that the sintering according to the present invention achieves a yield point of 269 MPa, a value considerably higher than 185 MPa and 180 MPa obtained for the Comparative Examples 1 and 2, respectively.

With respect to tensile strength, the sintering according to the present invention yields a noticeably higher tensile strength of 315 MPa as compared with 220 MPa and 210 MPa obtained for the Comparative Examples 1 and 2, respectively.

It can be readily understood from Table 1 that the sintering of the present invention yields excellent elongation as compared with those of the Comparative Examples 1 and 2.

Figure 6:
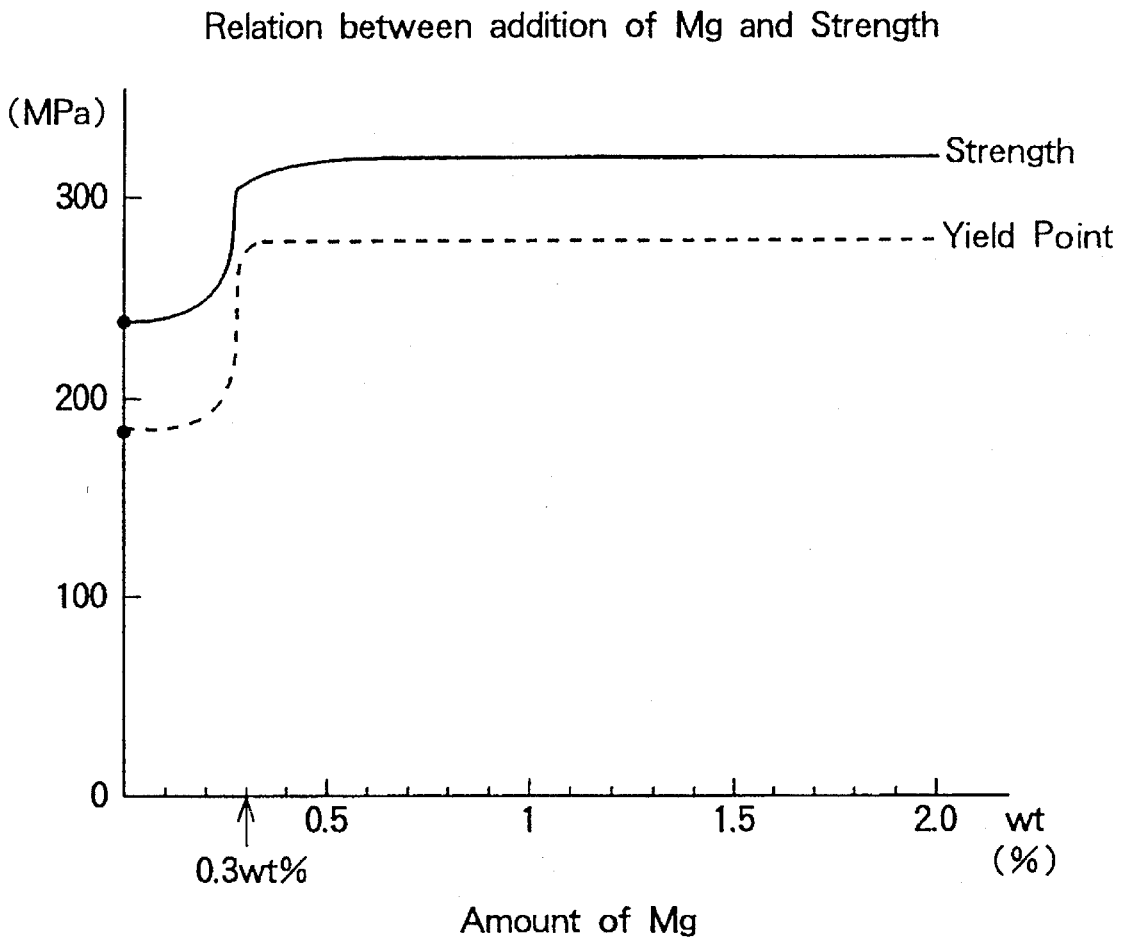
FIG. 6 is a graph showing the change in yield point and tensile strength with changing addition amounts of magnesium.

FIG. 6 is a graph showing the change in yield point (MPa) and strength (MPa) with changing addition of magnesium (% by weight). In the graph, the ordinate represents the yield point (MPa) and the abscissa represents the concentration of magnesium (% by weight).

The graph shown in FIG. 6 indicates that, from the point the concentration of magnesium attains 0.3% by weight, the yield point (MPa) and the strength (MPa) rapidly increase with increasing addition of magnesium. Accordingly, it is preferred to add magnesium for a concentration of 0.3% by weight or higher. However, the yield point and the strength no longer increase with increasing concentration of magnesium from the point the addition of magnesium attains a concentration of 0.5% by weight. It can be seen therefrom that no drastic improvement in yield point and strength can be expected with increasing addition of magnesium in a concentration range of 0.5% by weight or higher.

Furthermore, an experiment of sublimating magnesium in gaseous nitrogen has been conducted. That is, magnesium has been gasified in gaseous nitrogen from the initial stage of the process without previously sublimating magnesium in a rare gas atmosphere such as in gaseous argon. In this case, however, gaseous magnesium which sublimated from the crucible is found to immediately react with gaseous nitrogen to form $Mg_3N_2$ in the surroundings of the crucible. Thus, $Mg_3N_2$ cannot reach the powder compact.

According to a first aspect of the present invention, a sintering of aluminum or an aluminum alloy is obtained by setting a compact of aluminum powder or an aluminum alloy powder inside a furnace together with magnesium or a magnesium alloy; heating the furnace while maintaining a rare gas atmosphere inside the furnace; sublimating magnesium form said magnesium or magnesium alloy by heating the furnace while reducing the pressure and maintaining the rare gas atmosphere inside the furnace; and thereafter introducing gaseous nitrogen inside the furnace while heating the inside of the furnace at a temperature not higher than the melting point of the powder compact, thereby reacting the sublimated magnesium with nitrogen to generate magnesium nitride ($Mg_3N_2$ ) and exposing metallic aluminum during the sintering process by bringing the resulting magnesium nitride into contact with aluminum oxide ($Al_2O_3$) on the surface of the aluminum powder or the aluminum alloy powder for the reduction of aluminum oxide. It can be seen therefrom that the bonding strength of the aluminum alloy particles can be increased while fully taking the advantage of sintering a powder compact. Thus, the process according to the present invention enables aluminum sinterings or aluminum-alloy sinterings improved in yield point, strength, and elongation.

An embodiment according to a second aspect of the present invention is described below.

Figure 7:
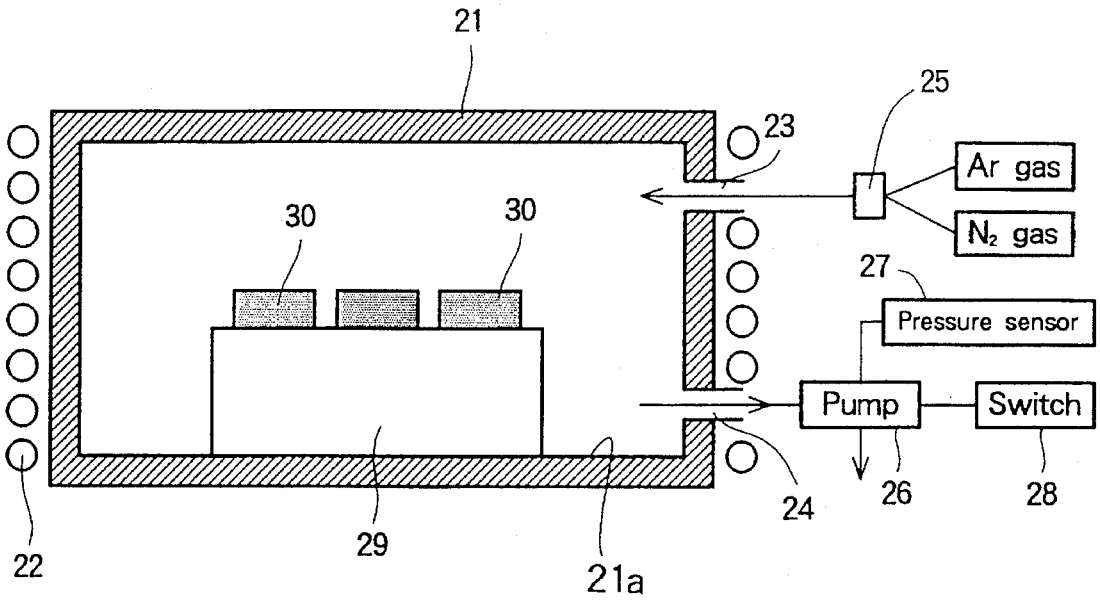
FIG. 7 is a schematically drawn cross sectional vertical side view of a sintering furnace for use in performing a process for producing an aluminum sintering according to a second aspect of the present invention.

FIG. 7 shows a sintering furnace similar to that described above, and it similarly comprises a heater 22 surrounding a furnace body 21. The furnace body 21 comprises a gas supply inlet 23 and a gas exhaust outlet 24 on one side thereof. The gas supply inlet 23 is equipped with a switching valve 25 so that argon gas or nitrogen gas can be selected according to the demand. The gas exhaust outlet 24 is connected to a pump 26, so that the inside of the furnace body 21 may be evacuated by operating the pump 26. The pump 26 is turned ON or OFF by the pressure sensor 27 that detects the pressure inside the furnace body 21 or by means of a manual switch 28.

A mount 29 on which a powder compact 30 of aluminum or an aluminum alloy is set is provided on the floor 21*a* of the furnace body 21. The powder compact 30 to be processed comprises an aluminum powder containing magnesium mixed therein, or a powder of an aluminum alloy containing magnesium.

The process for sintering the powder compact 30 is described below. FIGS. 2(A) to 2(D) described hereinbefore apply to the procedures of the sintering process according to the present embodiment. Accordingly, the details are excluded from the description below.

A rare gas such as gaseous argon is introduced inside the furnace body 21 to set a rare gas atmosphere inside the furnace 21. The pressure inside the furnace is set at the atmospheric pressure. Under these conditions, the powder compact is then heated at, for example, 400° C. for a duration of 90 minutes. During this heat treatment, the wax incorporated into the powder compact 30 as a lubricant and a binder is removed by melting and evaporation.

Figure 8:
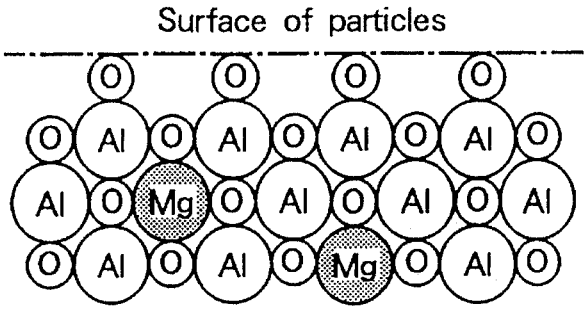
FIG. 8 is a schematically shown arrangement of atoms inside a particle of aluminum powder according to a second aspect of the present invention before magnesium undergoes sublimation.

FIG. 8 is a schematically shown particle structure inside the powder compact 30. In this stage, a layer of $Al_2O_3$ containing aluminum atoms and 0 atoms tightly bonded with each other is formed on the surface of the aluminum alloy powder particles. The atmosphere inside the furnace can be changed into a rare gas at the stage when magnesium is sublimated or gasified, which is to be described hereinafter.

The inside of the furnace body 21 is evacuated thereafter. For instance, the pressure inside the furnace is reduced to 10 Torr or lower, and more preferably, to a pressure of about 0.1 Torr. Then, while maintaining the rare gas atmosphere, heating is effected at 500° C. for a duration of 5 minutes.

Figure 9:
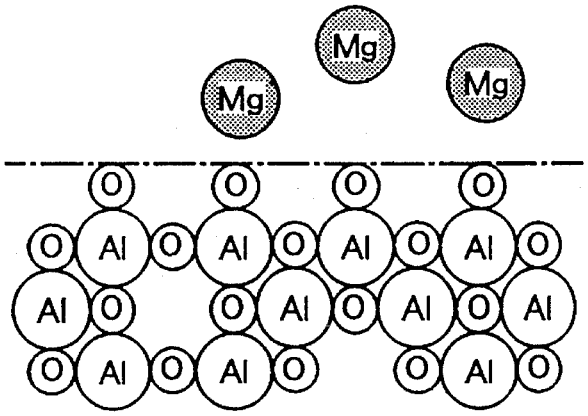
FIG. 9 is a schematically shown arrangement of atoms inside a particle of aluminum powder according to a second aspect of the present invention after magnesium underwent sublimation.

During this process, as shown in FIG. 9, magnesium incorporated in the aluminum or aluminum alloy powder is sublimated (gasified). The gaseous magnesium thus generated by sublimation uniformly diffuses into the surface and the inside of the powder compact without reacting with argon.

In addition to the aforementioned argon, usable rare gases include helium (He), neon (Ne), krypton (Kr), xenon (Xe), and radon (Rn).

Figure 10:
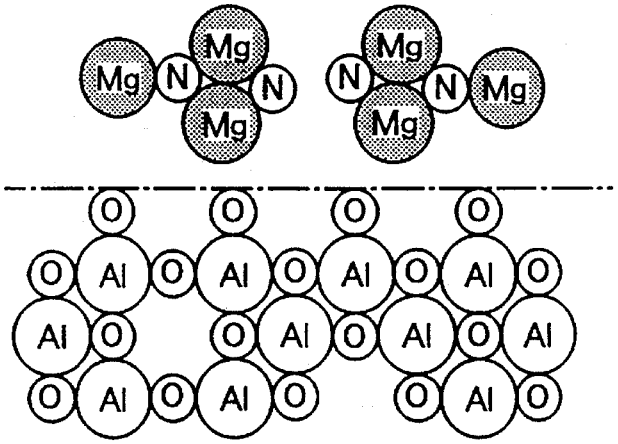
FIG. 10 is a schematically shown bonding state of sublimated magnesium with nitrogen according to a second aspect of the present invention.
Figure 11:
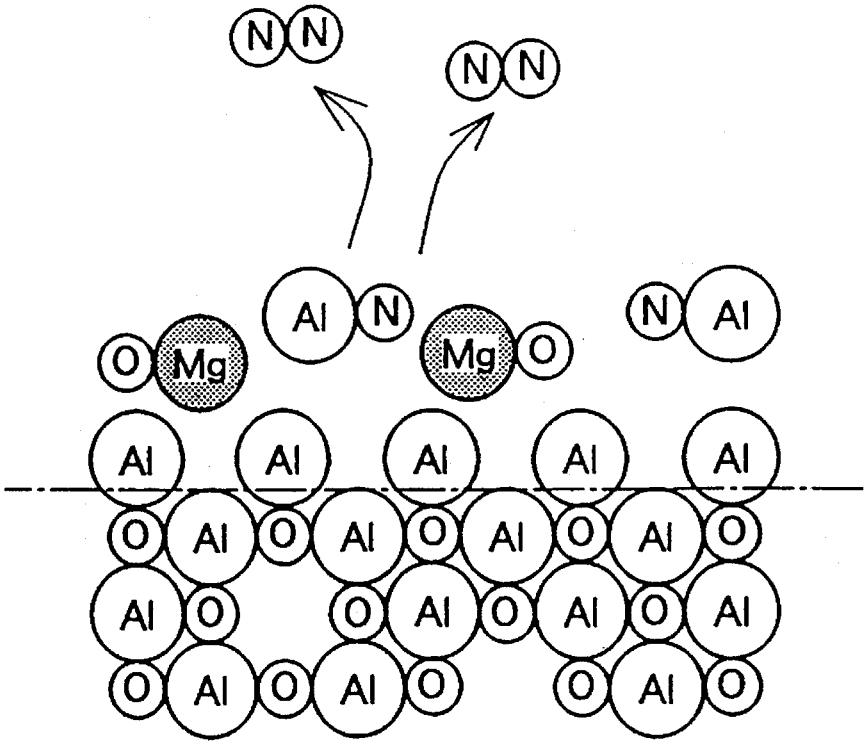
FIG. 11 is a schematically shown exposed state of aluminum according to the second aspect of the present invention, while magnesium is bonded with oxygen.

Then, gaseous nitrogen ($N_2$) is introduced at once inside the furnace body 21. At the same time, the temperature inside the furnace is elevated to a value not higher than the melting point of A1, for instance, to 540° C. By introducing gaseous nitrogen ($N_2$), the sublimated gaseous magnesium and nitrogen undergo reaction as to generate magnesium nitride ($Mg_3N_2$) as shown in FIG. 10.

The thus generated magnesium nitride ($Mg_3N_2$) contacts with aluminum oxide ($Al_2O_3$) on the surface of aluminum or aluminum alloy powder particles, and effects an oxidation-reduction reaction. More specifically, oxygen atoms desorbs from $Al_2O_3$ to expose aluminum atoms on the surface of the powder particles.

The reaction which occurs inside the furnace can be represented by the following formulae which are the same as those described hereinbefore:

$$3Mg_{(gas)}+N_2=Mg_3N_2 \quad (1)$$

$$2Mg_3N_2+2Al_2O_3=2AlN+6MgO+2Al+N_2 \quad (2)$$

$$Mg_3N_2+2Al_2O_3+3Mg=2AlN+6MgO+2Al \quad (3)$$

Gibbs free energy of formation ($\Delta G$) is negative for all of the reactions expressed by the formulae above. Hence, the reactions expressed above proceed from the left hand side to the right hand side. It can be seen therefrom that oxygen atoms desorb from $Al_2O_3$ in the presence of $Mg_3N_2$.

In Table 2 are compared the characteristics of the sintered products produced by the process according to the present invention with those produced by other comparative processes.

The process conditions are given below.

Sintering (present invention)

Two types of materials are prepared. One is an Al-10Si-4Cu-2 Mg alloy system containing 0.3% by weight or more of magnesium, and the other is a mixed powder system Al-10Si-4Cu-1 Mg obtained by adding powders of alloy components to a powder of pure aluminum. More specifically, the starting mixed powder contains 33.3% by weight of Al-30 wt. %Si, 20% by weight of Al-20 wt. %Cu, 2% by weight of Al-50 wt. %Mg, from 0.5 to 2% by weight of wax, and balance pure A1.

The powder of the material above passed through a 100-mesh sieve is mixed for 30 minutes in a twin-cylinder mixer, and is compressed into a powder compact having a relative density of from 60 to 85% by applying a pressure in a range of from 5 to 7 ton/cm$^2$ in case of a powder compact and a pressure of from 4 to 6 ton/cm$^2$ in case of a mixed powder. $Mg_3N_2$ can be diffused uniformly inside the molding by controlling the density of the molding in the thus specified range of from 60 to 85%.

The powder compact is then heated at 400° C. for a duration of 90 minutes in gaseous argon for the first-stage heating, and at 540° C. for a duration of 60 minutes in gaseous nitrogen ($N_2$) for the final-stage reactions and sintering heating.

Forging

Forging is effected at a draught of 40% by maintaining the mold temperature at 400° C. and the billet temperature at 450° C.

Heat Treatment

Heat treatment iS effected by setting the solution heat treatment temperature at 490° C. and performing aging at 190° C. for a duration of 3 hours.

TABLE 2

| | Use of Mg Source | Use of $N_2$ gas | Yield Point (MPa) | Tensile Strength (MPa) | Elongation (%) |
|---|---|---|---|---|---|
| Present Invention | Yes | Yes | 277 | 320 | 4.0 |
| Comp. Ex. 3 (No Mg source) | No | Yes | 190 | 240 | 1 ≦ |
| Comp. Ex. 4 (No $N_2$ gas) | Yes | No | 196 | 238 | 1 ≦ |

Table 2 indicates that the sintering according to the present invention realizes a yield point of 277 MPa, a value considerably higher than 190 MPa and 196 MPa obtained for the Comparative Examples 3 and 4, respectively.

With respect to tensile strength, the sintering according to the present invention yields a noticeably higher tensile strength of 320 MPa as compared with 240 MPa and 238 MPa obtained for the Comparative Examples 3 and 4, respectively.

It can be readily understood from Table 2 that the sintering of the present invention yields excellent elongation as compared with those of the Comparative Examples 3 and 4.

The same tendency as that obtained in the graph of FIG. 6 above is observed for the change in yield point (MPa) and strength (MPa) with changing addition of magnesium (% by weight). Thus, from the point the concentration of magnesium attains 0.3% by weight, the yield point (MPa) and the strength (MPa) rapidly increase with increasing addition of magnesium. Accordingly, it is preferred to add magnesium for a concentration of 0.3% by weight or higher. However, in the same manner as above, the yield point and the strength are found to no longer increase with increasing concentration of magnesium from the point the addition of magnesium attains a concentration of 0.5% by weight.

An experiment of sublimating magnesium in gaseous nitrogen has been conducted. That is, magnesium has been gasified in gaseous nitrogen from the initial stage of the process without once sublimating magnesium in a rare gas atmosphere such as of argon. In this case, however, gaseous magnesium which sublimated from the crucible immediately reacted with gaseous nitrogen to form $Mg_3N_2$ distributed non-uniformly in the powder compact. Accordingly, the reduction $Al_2O_3$ occurrs only insufficiently.

According to a second aspect of the present invention, sintering is effected by a process comprising: setting, inside a furnace, a compact of a powder of aluminum with magnesium mixed therein or of an aluminum alloy powder containing 0.3% by weight or more of magnesium; heating the furnace while maintaining a rare gas atmosphere inside the furnace; sublimating the magnesium from the powder compact of aluminum containing magnesium mixed therein or the powder compact of aluminum alloy containing magnesium, by heating the furnace while reducing the pressure and maintaining the rare gas atmosphere inside the furnace; and thereafter gaseous nitrogen inside the furnace while heating the inside of the furnace at a temperature not higher than the melting point of the powder compact, thereby reacting the sublimated magnesium with nitrogen to generate magnesium nitride ($Mg_3N_2$) and exposing metallic aluminum during a sintering process by bringing the resulting magnesium nitride into contact with aluminum oxide ($Al_2O_3$) on the surface of the aluminum powder or the aluminum alloy powder for the reduction of aluminum oxide. It can be seen therefrom that, similar to the first aspect of the present invention above, the bonding strength of the aluminum alloy particles can be increased while fully taking the advantage of sintering a powder compact. Thus, the process according to the present invention enables aluminum sinterings or aluminum-alloy sinterings improved in yield point, strength, and elongation.

While the invention has been described in detail and with reference to specific preferred embodiments thereof, it will be apparent to one skilled in the art that various changes and modifications can be made therein without departing from the spirit and scope thereof.

What is claimed is:

1. A process for producing an aluminum sintering, comprising the steps of:

setting a compact of aluminum powder or an aluminum alloy powder inside a furnace together with a magnesium source;

heating the furnace while maintaining a rare gas atmosphere inside the furnace;

sublimating magnesium from said magnesium source inside the furnace;

introducing gaseous nitrogen inside the furnace while heating the inside of the furnace at a temperature below a melting point of the powder compact, thereby reacting the sublimated magnesium with nitrogen to generate magnesium nitride ($Mg_3N_2$) and exposing metallic aluminum by bringing the resulting magnesium nitride into contact with aluminum oxide ($A1_2O_3$) on a surface of the aluminum powder or the aluminum alloy powder for reduction of the aluminum oxide, and while sintering said compact.

2. A process for producing an aluminum sintering as claimed in claim 1, wherein, wax is removed from the powder compact during said step of heating the powder compact while maintaining the rare gas atmosphere inside the furnace.

3. A process for producing an aluminum sintering as claimed in claim 1, wherein, the step of sublimating magnesium is effected in a rare gas atmosphere and under a reduced pressure.

4. A process for producing an aluminum sintering as claimed in claim 1, wherein, an amount of magnesium sublimated from said magnesium source accounts for at least 0.3% by weight of a combined weight of the magnesium amount and the powder compact.

5. A process for producing an aluminum sintering as claimed in claim 1, wherein, said rare gas is selected from a group consisting of argon, helium, neon, krypton, xenon, and radon.

6. A process for producing an aluminum sintering, comprising the steps of:

setting a compact of a powder of aluminum with magnesium mixed therein or an aluminum alloy powder containing magnesium inside a furnace;

heating the furnace while maintaining a rare gas atmosphere inside the furnace;

sublimating said magnesium from the powder compact inside the furnace; and introducing gaseous nitrogen inside the furnace while heating the inside of the furnace at a temperature below a melting point of the powder compact, thereby reacting the sublimated magnesium with nitrogen to generate magnesium nitride ($Mg_3N_2$) and exposing metallic aluminum by bringing the resulting magnesium nitride into contact with aluminum oxide ($Al_2O_3$) on a surface of the aluminum powder or the aluminum alloy powder for reduction of the aluminum oxide, and while sintering said compact.

7. A process for producing an aluminum sintering as claimed in claim 6, wherein, wax is removed from the powder compact during said step of heating the powder compact while maintaining the rare gas atmosphere inside the furnace.

8. A process for producing an aluminum sintering as claimed in claim 6, wherein, the step of sublimating magnesium is effected in a rare gas atmosphere and under a reduced pressure.

9. A process for producing an aluminum sintering as claimed in claim 6, wherein, said magnesium accounts for 0.3% by weight or more of the powder compact.

10. A process for producing an aluminum sintering as claimed in claim 6, wherein, said rare gas is selected from a group consisting of argon, helium, neon, krypton, xenon, and radon.

11. A process for producing an aluminum sintering as claimed in claim 1, wherein said magnesium source is mixed with said aluminum powder or said aluminum alloy powder in said compact.

12. A process for producing an aluminum sintering as claimed in claim 11, wherein magnesium of said magnesium source accounts for at least 0.3% by weight of the powder compact.

13. A process for producing an aluminum sintering as claimed in claim 1, wherein said magnesium source is provided separately from said compact inside of said furnace.

14. A process or producing an aluminum sintering as claimed in claim 3, wherein said steps of heating the furnace while maintaining a rare gas atmosphere inside the furnace and of introducing gaseous nitrogen inside the furnace while heating inside of the furnace and sintering said compact are effected at substantially atmospheric pressure, and said step of sublimating magnesium is effected under a reduced pressure of 10 Torr or lower.

15. A process or producing an aluminum sintering as claimed in claim 8, wherein said steps of heating the furnace while maintaining a rare gas atmosphere inside the furnace and of introducing gaseous nitrogen inside the furnace while heating inside of the furnace and sintering said compact are effected at substantially atmospheric pressure, and said step of sublimating magnesium is effected under a reduced pressure of 10 Torr or lower.

16. A process for producing an aluminum sintering as claimed in claim 1, wherein said compact is composed of an aluminum mixed powder containing about 33.3% by weight of an aluminum alloy containing about 30% of weight of silicon, about 28% by weight of an aluminum alloy containing about 20% by weight of copper, about 0.5–2% by weight of wax, and a balance of pure aluminum.

17. A process for producing an aluminum sintering as claimed in claim 6, wherein said compact is composed of an aluminum mixed powder containing about 33.3% by weight of an aluminum alloy containing about 30% of weight of silicon, about 28% by weight of an aluminum alloy containing about 20% by weight of copper, about 0.5–2% by weight of wax, and a balance of pure aluminum.

18. A process for producing an aluminum sintering as claimed in claim 1, wherein a molding density of said compact is 60–85%.

19. A process for producing an aluminum sintering as claimed in claim 6, wherein a molding density of said compact is 60–85%.

20. A process for producing aluminum sintering as claimed in claim 1, wherein said step of heating the furnace while maintaining a rare gas atmosphere inside the furnace is conducted at approximately 400° C., said step of sublimating magnesium is conducted at approximately 500° C., and said step of introducing gaseous nitrogen while sintering compact is conducted at approximately 540° C.

* * * * *

UNITED STATES PATENT AND TRADEMARK OFFICE

CERTIFICATE OF CORRECTION

PATENT NO. : 5,525,292

DATED : June 11, 1996

INVENTOR(S) : Yasuhiro Nakao, Kunitoshi Sugaya, Shigehisa Seya, Takeshi Sakuma

It is certified that error appears in the above-indentified patent and that said Letters Patent is hereby corrected as shown below:

On the cover page, in the Abstract, line 7, after "magnesium" insert --from the magnesium source; supplying gaseous--.

Column 1, line 25, before "generated" insert --is--.

Column 2, line 9, change "there is" to --there are--;
line 11, change "prevent" to --present--.

Column 3, lines 10-11, change "aluminumalloy" to --aluminum alloy--;
line 13, change "a" (first occurrence) to --the--.

Column 4, lines 66-67, change "represents" to --represent--;
line 67, after "temperature" insert a comma.

Column 5, line 3, change "represents" to --represent--;
line 16, delete "at";
line 23, before "(O)" insert --oxygen--;
line 24, change "exits" to --exists--;
line 47, change "Al" to --Al--;
line 55, after "$Mg_3N_2$" delete the semicolon;
line 56, change "desorbs" to --desorb--.

Column 6, line 3, change "$Al_2O_3$" to --$Al_2O_3$--;
line 4, change "the reaction" to --these reactions--;
line 14, change "Al" (both occurrences) to --Al--;
line 16, change "Al" to --Al--.

Column 7, line 25, change "form" to --from--.

Column 8, line 33, change "Al" to --Al--;
line 40, change "desorbs" to --desorb--.

Column 9, line 4, change "Al" to --Al--;
line 23, change "iS" to --is--.

UNITED STATES PATENT AND TRADEMARK OFFICE

CERTIFICATE OF CORRECTION

PATENT NO. : 5,525,292

DATED : June 11, 1996

INVENTOR(S) : Yasuhiro Nakao, Kunitoshi Sugaya, Shigehisa Seya, Takeshi Sakuma

It is certified that error appears in the above-indentified patent and that said Letters Patent is hereby corrected as shown below:

Column 10, 15th line, after "thereafter" insert --introducing--;
line 52, change "($Al_2O_3$)" to --($Al_2O_3$)--.

Column 12, line 7, change "or" to --for--;
15th line, change "or" to --for--;
approx. line 25, change "30% of weight" to --30% by weight--;
approx. line 32, change "30% of weight" to --30% by weight--.

Signed and Sealed this

First Day of October, 1996

Bruce Lehman

*Attest:*

BRUCE LEHMAN

*Attesting Officer*

*Commissioner of Patents and Trademarks*